US009248476B2

(12) United States Patent
De Palma

(10) Patent No.: US 9,248,476 B2
(45) Date of Patent: Feb. 2, 2016

(54) MULTISPEED DEVICE FOR POLISHING AND CLEANING JEWELRY

(71) Applicant: DePalma Enterprises Inc., San Clemente, CA (US)

(72) Inventor: Robert De Palma, San Clemente, CA (US)

( * ) Notice: Subject to any disclaimer, the term of this patent is extended or adjusted under 35 U.S.C. 154(b) by 148 days.

(21) Appl. No.: 14/071,734

(22) Filed: Nov. 5, 2013

(65) Prior Publication Data

US 2014/0123413 A1 May 8, 2014

Related U.S. Application Data

(60) Provisional application No. 61/722,447, filed on Nov. 5, 2012.

(51) Int. Cl.

| | |
|---|---|
| ***B08B 1/04*** | (2006.01) |
| ***A47L 25/00*** | (2006.01) |
| ***B24B 23/02*** | (2006.01) |
| ***B24B 29/00*** | (2006.01) |
| ***B24B 47/12*** | (2006.01) |
| ***B24D 13/14*** | (2006.01) |
| *B08B 1/00* | (2006.01) |

(52) U.S. Cl.
CPC . *B08B 1/04* (2013.01); *A47L 25/00* (2013.01); *B24B 23/02* (2013.01); *B24B 29/005* (2013.01); *B24B 47/12* (2013.01); *B24D 13/145* (2013.01); *A46B 2200/3086* (2013.01); *B08B 1/002* (2013.01)

(58) Field of Classification Search
CPC ..... B08B 1/04; B08B 1/002; B24B 29/005; A47L 25/00
See application file for complete search history.

(56) References Cited

U.S. PATENT DOCUMENTS 5,870,790 A * 2/1999 Root et al. ..... 15/22.1
5,881,418 A * 3/1999 Enoch ..... 15/101

* cited by examiner

*Primary Examiner* — Shay Karls
(74) *Attorney, Agent, or Firm* — Locke Lord LLP; Howard M. Gitten

(57) ABSTRACT

A device for cleaning and polishing jewelry having a housing and a motor in the housing. A first gear is operatively engaged with the motor and has a drive shaft extending from the gear. The first gear is driven by the drive gear at a first speed. A second gear has a hole therein with the drive shaft extending therethrough. The second gear is operatively driven by the drive gear at a second speed and the hole.

17 Claims, 6 Drawing Sheets

MULTISPEED DEVICE FOR POLISHING AND CLEANING JEWELRY

CROSS REFERENCE TO RELATED APPLICATION

This application claims priority of U.S. Provisional Application No. 61/722,447, filed Nov. 5, 2013, the contents of which are incorporated herein.

BACKGROUND OF THE INVENTION

This invention is directed to a device for cleaning and polishing jewelry and more particularly, to a multispeed device capable of polishing jewelry operating at one speed and cleaning jewelry operating at at least a second speed.

Devices are well known in the art for both polishing and cleaning jewelry, particularly gemstones. By way of example, it is known in the art to clean jewelry with a kit, usually including cleaning liquid or gel and a brush. The gemstone is dipped or rinsed in the fluid or gel and then scrubbed with the brush to remove dirt. This prior art device has been satisfactory however, it is labor intensive and requires soaking time when a fluid is used and does not provide for polishing. It is also known in the art to use an ultrasonic chamber to gently vibrate dirt from jewelry. This device has also been satisfactory, however it also requires a separate device in order to polish jewelry, resulting in increased cost and the need to buy several tools. Separate and distinct polishing tools are known in the art, but are expensive devices for use by professionals, and not conducive for casual home use.

Accordingly, a device which polishes and cleans jewelry and which overcomes the shortcomings of the prior art is desired.

BRIEF SUMMARY OF THE INVENTION

A multispeed device for polishing and cleaning jewelry includes a housing. A motor is mounted in the housing. A polishing gear is operatively coupled to the motor and rotates at a first speed. A tool drive shaft is operatively coupled to the polishing gear and extends at the center thereof. A cleaning gear is operatively coupled to the motor for rotating at a second speed and has a cleaning gear hole in the center hole thereof; the cleaning gear hole is coaxially aligned with the polishing gear and disposed in the housing to allow the tool drive shaft to extend therethrough. A polishing tool includes a shaft, the shaft being dimensioned to be received within the housing and engage the polishing shaft. A cleaning tool has a shaft dimensioned to be received within the housing and engage the cleaning gear, but not the tool drive shaft.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
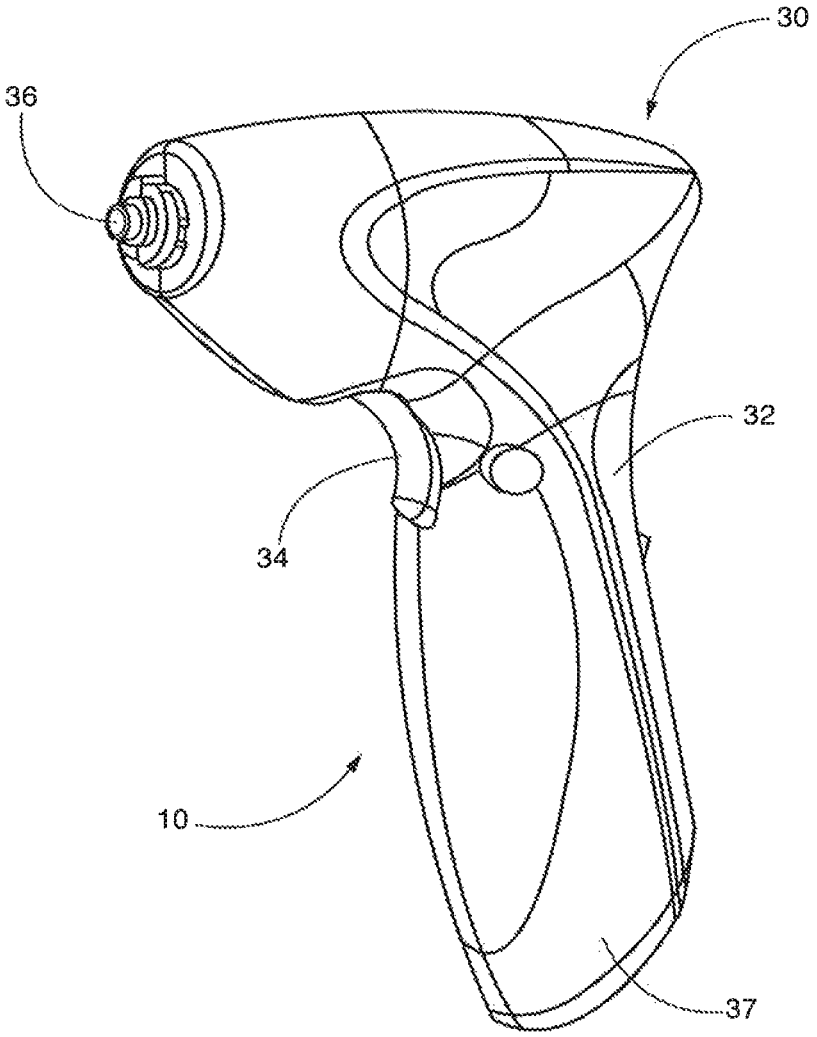
FIG. 1 is a perspective view of a gun housing for a cleaning and polishing device constructed in accordance with the invention.

Reference is made to FIG. 1. An apparatus 10 includes a housing 30, which in a preferred embodiment is substantially gun shaped, having a handle portion 37. A trigger 34 is movably disposed within housing 30. An opening 36 for receiving tools, as will be discussed in greater detail below, is at a front end of housing 30 and communicates with the interior of housing 30. A door 32 for selectively opening and sealing a battery compartment is disposed on housing 30.

Figure 2:
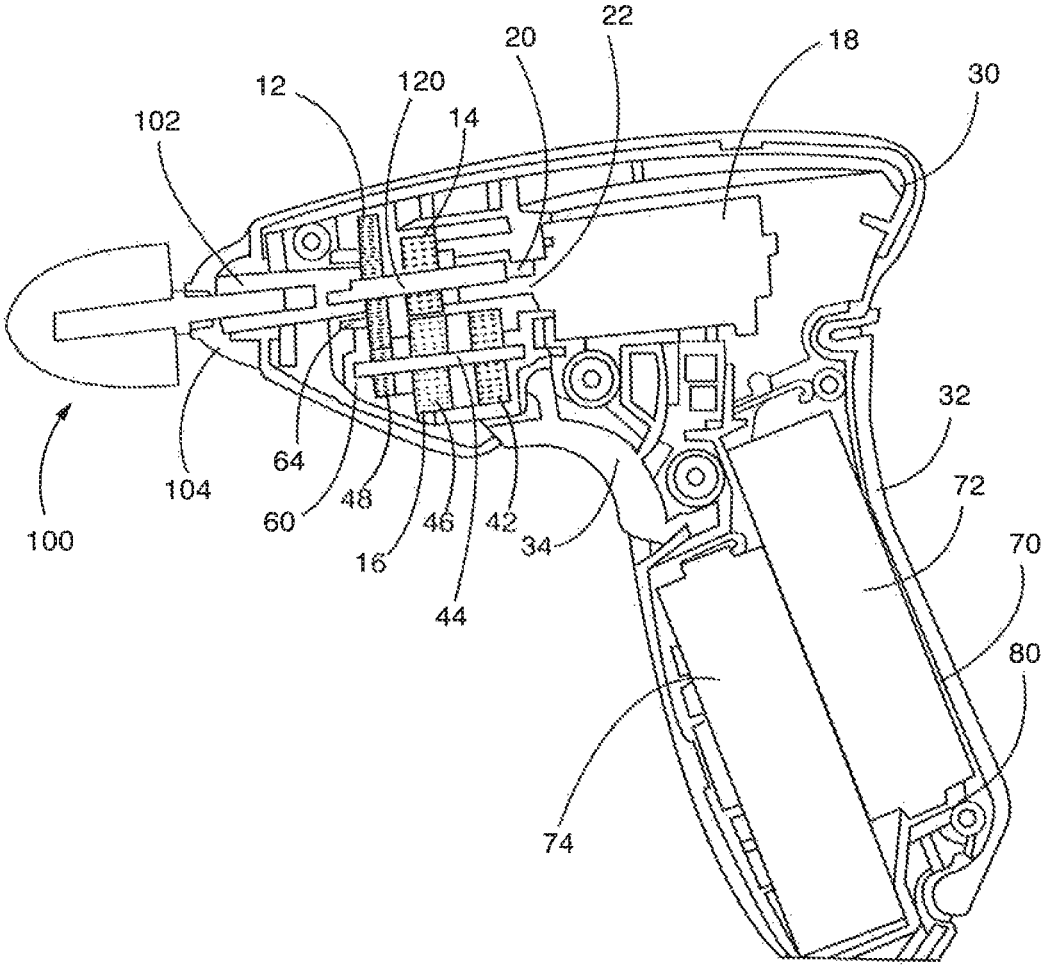
FIG. 2 is a sectional schematic view of the cleaning and polishing device constructed in accordance with the invention with a polishing too therein.
Figure 3:
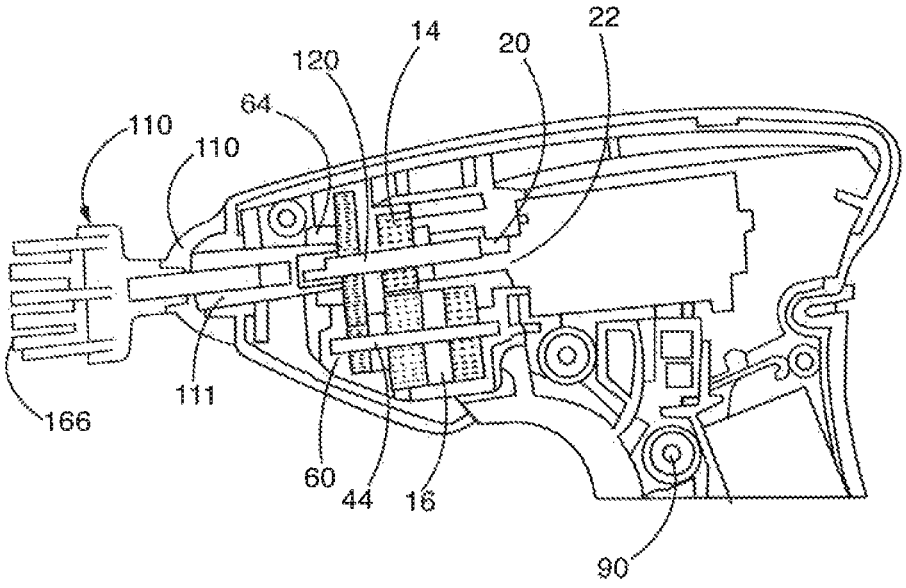
FIG. 3 is a sectional schematic view of the cleaning and polishing device constructed in accordance with the invention with a cleaning tool therein.
Figure 4:
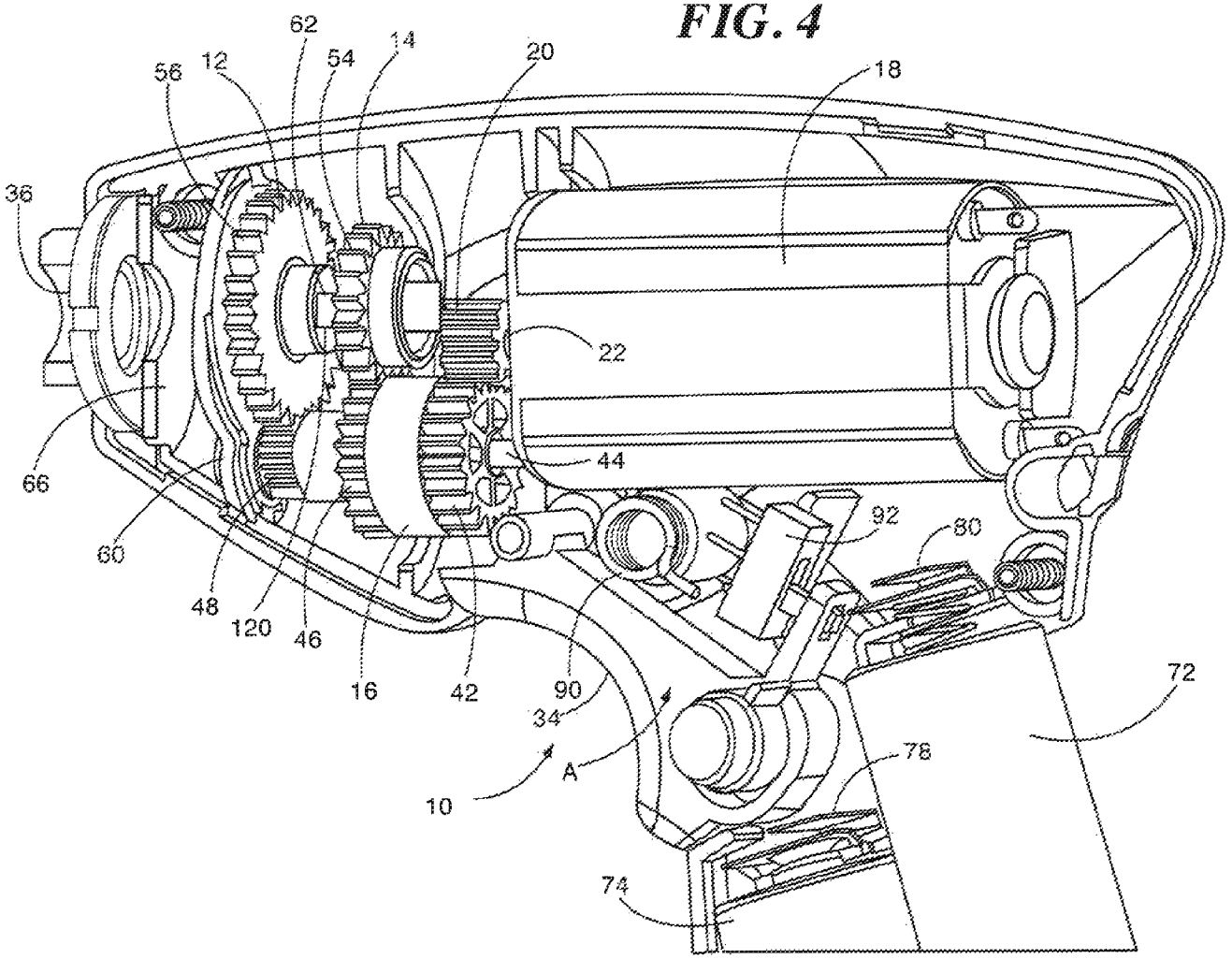
FIG. 4 is a sectional schematic view of the cleaning and polishing device constructed in accordance with the invention.

As seen in FIGS. 2-4, a motor 18 is disposed within housing 30. Motor 18 includes a driven shaft 22. A drive gear 20 is disposed on driven shaft 22 to turn therewith. A shaft 44 extends from the housing of motor 18 and supports an idler gear 16 thereon. Idler gear 16 has a first set of gear teeth 42. A second set of gear teeth 46 is spaced from gear teeth 42 and distally located from gear teeth 42 relative to motor 18. Idler gear 16 includes a third set of gear teeth 48 distally positioned relative to gear teeth 42, 46. For stability, idler gear 16 is supported at its distal end on a bracket 60 disposed within housing 30. Gear teeth 42 of idler gear 16 mesh with the teeth of drive gear 20 so that rotation of drive gear 20 rotates idler gear 16.

A first gear acting as a polishing gear 14 having teeth 54 is rotatably disposed within housing 30. A drive shaft 120 extends from the center of (FIG. 4) polishing gear 14. Polishing gear 14 is disposed within housing 30 such that teeth 54 mesh with teeth 46 of idler gear 16 and tool drive shaft 120 is coaxial with housing opening 36.

A second gear acting as a cleaning gear 12 is rotatably disposed within housing 30 between polishing gear 14 and opening 36. Cleaning gear 12 has teeth 56 and hole 62 extending through the center of gear 12. Cleaning gear 12 is disposed within housing 30 such that teeth 56 engage teeth 48 of idler gear 16 and hole 62 is coaxial with tool drive shaft 120 and sized so that tool drive shaft 120 extends therethrough without tool drive shaft 120 engaging hole 62. An engaging member 64 extends from gear 12 coaxial with hole 62, with an inner diameter greater than the diameter of hole 62.

In a preferred embodiment, polishing gear 14 rotates at a greater rotational speed than cleaning gear 12. This may be accomplished in several ways. In the present preferred embodiment, polishing gear 14 has a smaller gear diameter as measured from the outer point of gear teeth 54 of polishing gear and/or a smaller tooth count than cleaning gear 12. Furthermore, this may be accomplished by the relative size and gear count of idler gear teeth 46 and 48. In this embodiment, the gear radius of idler gear 16 at gear teeth 48 is less than the diameter of idler gear 16 at gear teeth 46, however this is done to accommodate the different diameters of the coaxial gears 12, 14 to promote meshing by utilizing a single idler gear 16, rather than more complex multigear arrangements.

In a preferred but non-limiting embodiment, motor 18 is an electric motor powered by batteries, as it is desired to make housing 30 portable. However, it is well within the scope of the invention to connect housing 30 to an electrical outlet as known in the art, or to use other power sources such as solar cells, or the like. A battery chamber 70 is disposed within housing 30 and is sized to receive one or more batteries, 72, 74 therein. Access to chamber 70 is provided by door 32 which is selectably opened and closed to receive batteries to allow use. Battery chamber 70 includes a first contact 78 and a second electrical contact 80. As known in the art, batteries 72, 74 are oriented between contact 78, 80 in a connection fit to create a power circuit.

A spring 90 biases trigger 34 outward from housing 30. Contacts 92 are disposed on trigger 34 and operate so that as trigger 34 moves in the direction of arrow A as it is squeezed, contacts 92 close a circuit between contact 78 and motor 18 to power motor 18 causing motor 18 to rotate gear 20. In effect, trigger 34 is the switch for turning motor 18 on and off.

Figure 5:
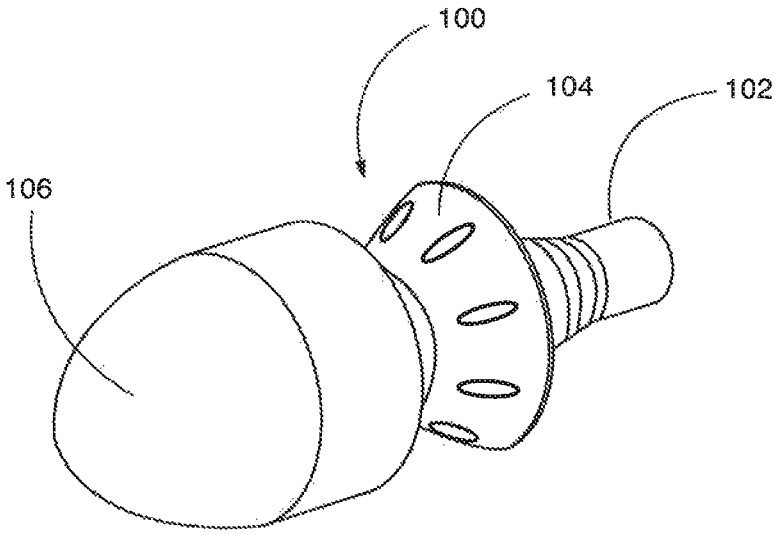
FIG. 5 is a perspective view of the cleaning tool constructed in accordance with the invention.

Reference is now made to FIG. 5 in which a first tool, a polishing tool, generally indicated as 100 is shown. Polishing tool 100 includes a shaft 102, a stop 104 and a polishing head 106, at a distal end of shaft 102. A stop 104 is disposed between polishing head 106 and a proximal end of shaft 102. Shaft 102 is sized to have a diameter and length sufficient to be received within engaging member 64 without touching engaging member 64 of polishing gear 14. Shaft 102 is hollow and receives tool drive shaft 120, engaging tool drive shaft 120 to rotate shaft 102. To further ensure fit, shaped structures such as a key may be disposed within shaft 102 to engage and mate with a mirror shaped end on tool drive shaft 120.

Figure 6:
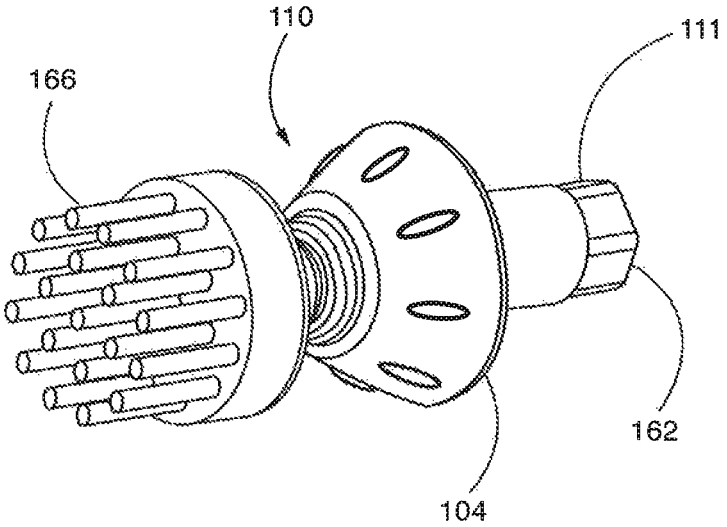
FIG. 6 is a perspective view of the polishing tool constructed in accordance with the invention.

As seen in FIG. 6, second tool 110, a cleaning tool, is similar in design to polishing tool 100. However, cleaning tool 110 has a different head for performing a different purpose and a different shaped shaft 111 to engage engaging member 64 of cleaning gear 112 without engaging tool drive shaft 120. Cleaning tool 111 includes a head 166 formed of brush bristles. In a preferred non-limiting embodiment, bristles 166 are substantially rigid, like those of a toothbrush, but as known to those skilled in the art, not so hard as to scratch the common elements from which jewelry is made such as silver, gold and precious stones. As with tool 100, a stop 104 is disposed between cleaning head bristles 166 and a proximal end 162 of shaft 111. Shaft 111 and engaging surface at proximal end 162 are sized to have a diameter and length sufficient to be received within engaging member 64 of cleaning gear 12 so that cleaning gear 12 rotates cleaning tool 110.

As seen from FIGS. 3 and 6, shaft 111 is hollow and has an inner circumference greater than the outer circumference of drive shaft 120. As a result, tool drive shaft 120 does not engage cleaning tool 110. Additionally, as seen in FIG. 6, the outer surface of shaft 111 may be shaped as a polygon to provide engaging corners to prevent slippage relative to engaging member 64.

Figure 7:
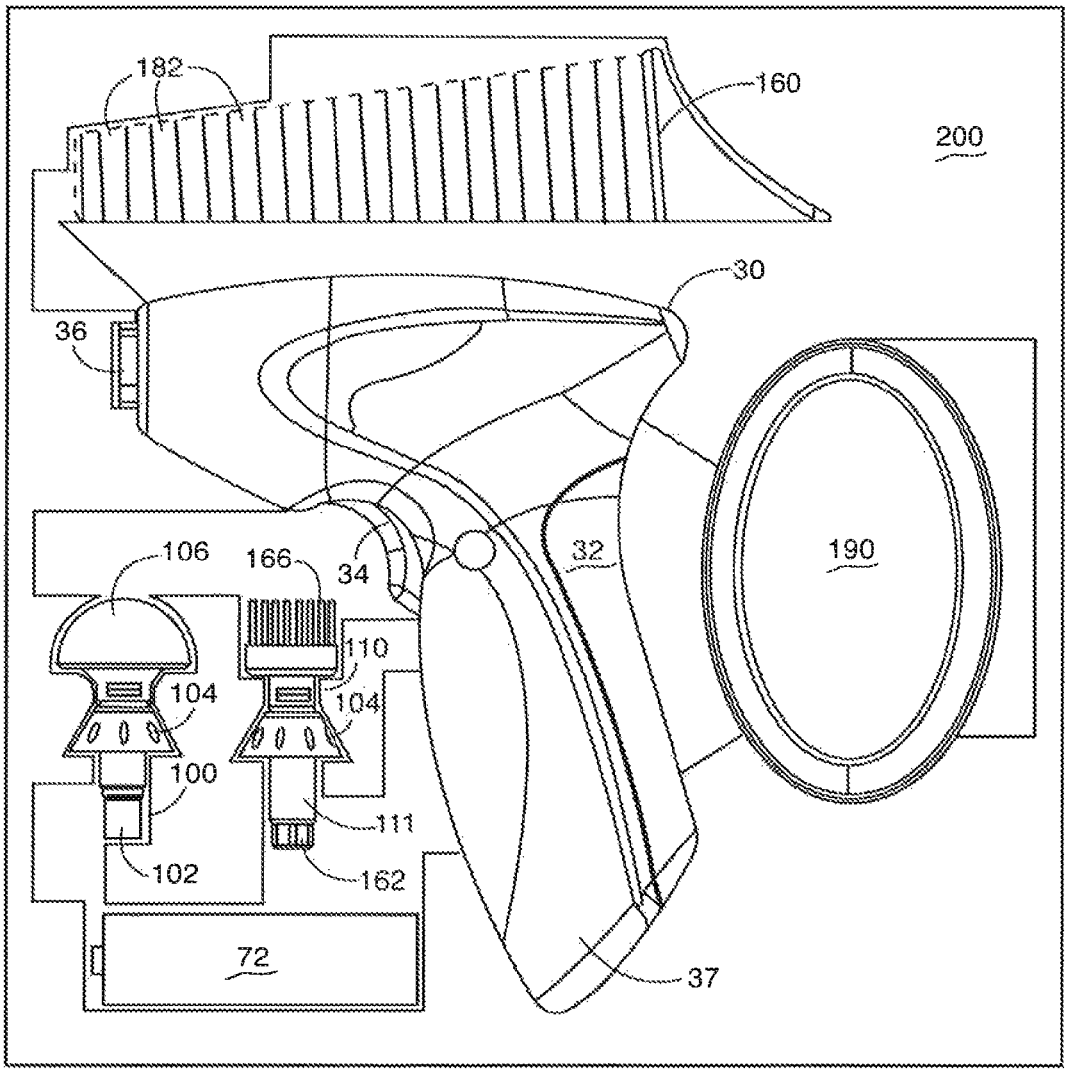
FIG. 7 is a top plan view of a kit version of the cleaning and polishing device.

Reference is now made to FIG. 7 in which an apparatus 10 is shown disassembled in a kit. The kit includes a box or positioning tray 200. Housing 30 is disposed in a central region of tray 200. Batteries 72 are disposed within the tray. Polishing tool 100 is disposed within the tray.

The kit disposed within tray 200 may also include a dish 190 for holding jewelry when not being cleaned or polished. Additionally, a frusto-conical support 180 may be provided having stepped rings 182 along its length. Stepped rings 182 are provided to receive and support varying diameter of rings, and even chains to support the rings and chains while being cleaned or polished with multispeed device 10. Furthermore, in a preferred but non-limiting embodiment, holes may be formed along the length of frusto-conical support 180 for attaching earrings or the like to be cleaned.

As shown in FIGS. 2 and 4, during use, shaft 102 of polishing tool 100, by way of example, is inserted through opening 36 until engaged within tool drive shaft 120 of polishing gear 14. Shaft 102 is inserted until stop 104 abuts housing 102. This prevents over insertion. Trigger 34 is squeezed closing the circuit, driving the polishing head to spin and polish the gem.

Cleaning tool 110 has a similar construction having a different type of head 166 is used. Cleaning tool also has a shaft 111 having a different inner and outer diameter than shaft 102 of polishing head 100. The shaft of cleaning tool 110 has a greater diameter so as to engage with the wider engaging member 64 of cleaning gear 12. As with shaft 102, the shaft 111 of cleaning tool 110, having a different sized diameter, engages engaging member 64 of cleaning gear 12 and because of its larger inner diameter, not tool drive shaft 120. The cleaning head, includes bristles 166 or other cleaning type surfaces to remove dirt, prior to polishing.

It should be noted, that by providing a first operating gear and a second operating gear coaxially in series, each sized and having structure to engage a different drive mechanism, it is possible to provide a single device capable of both polishing and cleaning jewelry. It should be noted, that because of the arrangement, either the polishing gear or the cleaning gear may be situated distally relative to the other to have the tool drive shaft, or the engaging member.

Many modifications and other embodiments of the invention will come to the mind of one skilled in the art having the benefit of the teachings presented in the foregoing descriptions and the associated drawings. Therefore, it is understood that the invention is not to be limited in the specific embodiments disclosed, and embodiments are intended to be included within the invention.

What is claimed is:

1. A device for cleaning and polishing jewelry comprising:
- a housing;
- a motor disposed in the housing;
- a first gear disposed in the housing and operatively driven by the motor, the first gear having a tool drive shaft extending therefrom; the first gear being driven by the motor at a first speed;
- a second gear disposed in the housing and having a hole therein, the second gear being operatively driven by the motor at a second speed and the hole of the second gear being coaxial with the tool drive shaft, the hole of the second gear having a circumference greater than a circumference of the tool drive shaft to receive the tool drive shaft therethrough without engaging the tool drive shaft.

2. The device of claim 1, further comprising an engaging member extending from the second gear and being coaxial with the hole, the engaging member releasably engaging a tool and the engaging member not engaging the tool drive shaft.

3. The device of claim 2, further comprising a releasable polishing tool, the releasable polishing tool having a polishing shaft selectively engaging the tool drive shaft and not engaging the engaging member, and the releasable polishing tool having a polishing head at a distal end of the polishing shaft.

4. The device of claim 3, wherein the polishing head is formed with a bullet shape.

5. The device of claim 2, further comprising a releasable cleaning tool, the releasable cleaning tool having a cleaning shaft for engaging the engaging member and not engaging the tool drive shaft, and the releasable cleaning tool having a cleaning head at a distal end of the cleaning shaft.

6. The device of claim 5, wherein the cleaning head is formed of bristles.

7. The device of claim 2, wherein the engaging member has a first shape, and further comprising a tool, the tool having a shaft; the shaft having a second shape; the second shape selectively engaging the first shape of the engaging member to rotate the tool.

8. The device of claim 1, further comprising a drive gear driven by the motor;

an idler gear, the idler gear having a first set of teeth, a second set of teeth, and a third set of teeth, the first set of teeth engaging the drive gear, the second set of teeth engaging the first gear, and the third set of teeth engaging the second gear the idler gear driving the first gear at a different speed than the idler gear drives the second gear.

9. The device of claim 1, wherein the housing includes an opening coaxial with the tool drive shaft and the hole of the second gear.

10. A system for cleaning and polishing jewelry comprising:

a cleaning and polishing apparatus having a housing; a motor disposed in the housing; a first gear disposed in the housing and operatively engaging the motor, the first gear having a tool drive shaft extending therefrom; the first gear being driven by the motor at a first speed; a second gear disposed in the housing and having a hole therein, the second gear being operatively driven by the motor at a second speed, and the hole of the second gear being coaxial with the tool drive shaft, the hole of the second gear having a circumference greater than a circumference of the tool drive shaft, the tool drive shaft extending the hole and not engaging the second gear; and an engaging member extending from the second gear, the engaging member not engaging the tool drive shaft;

a releasable polishing tool having a shaft selectively engaging the tool drive shaft and not engaging the engaging member; and a releasable cleaning tool having a cleaning shaft for selectively engaging the engaging member and not engaging the tool drive shaft.

11. The system of claim 10, wherein the polishing tool further comprises a polishing head at a distal end of the polishing shaft, the polishing head being disposed outside the housing, when the polishing tool engages the tool drive.

12. The system of claim 10, wherein the cleaning tool further comprises a cleaning head at a distal end of the cleaning shaft, the cleaning head being disposed outside of the housing, when the cleaning tool engages the tool drive.

13. The system of claim 10, further comprising a drive gear driven by the motor;

an idler gear, the idler gear having a first set of teeth, a second set of teeth and a third set of teeth, the first set of teeth engaging the drive gear, the second set of teeth engaging the first gear, and the third set of teeth engaging the second gear; the idler gear driving the first gear at a different speed than the idler gear drives the second gear.

14. The device of claim 10, wherein the cleaning head is formed of bristles.

15. The system of claim 10, wherein the polishing head is formed with a bullet shape.

16. The device of claim 10, wherein the housing includes an opening coaxial with the tool drive shaft and the hole on the second gear, the polishing shaft and cleaning shaft being independently respectively received within the opening.

17. The system of claim 10, wherein the engaging member has a first shape, and wherein only one of the cleaning shaft and the polishing shaft have a second shape, the second shape selectively engaging the first shape of the engaging member to rotate the tool having the second shape.

* * * * *